US007681408B2

(12) United States Patent
Hobson et al.

(10) Patent No.: US 7,681,408 B2
(45) Date of Patent: Mar. 23, 2010

(54) AUTOMATED ICE VENDING MACHINE AND METHOD OF VENDING ICE

(75) Inventors: Robert Michael Hobson, Albany, GA (US); James M Clark, Fernandina Beach, FL (US); Warren Christopher Johnston, Moultrie, GA (US)

(73) Assignee: Paper Making Controls Service, Inc., Moultrie, GA (US)

( * ) Notice: Subject to any disclaimer, the term of this patent is extended or adjusted under 35 U.S.C. 154(b) by 331 days.

(21) Appl. No.: 11/634,557

(22) Filed: Dec. 6, 2006

(65) Prior Publication Data

US 2007/0240441 A1 Oct. 18, 2007

Related U.S. Application Data

(60) Provisional application No. 60/748,346, filed on Dec. 7, 2005.

(51) Int. Cl.
*F25C 5/18* (2006.01)

(52) U.S. Cl. ..... 62/137; 62/344; 53/459; 53/570; 222/227; 222/252; 222/412

(58) Field of Classification Search ..... 62/137, 62/344; 222/227, 236, 238, 252, 412, 413; 53/459, 570

See application file for complete search history.

(56) References Cited

U.S. PATENT DOCUMENTS

| | | | | | |
|---|---|---|---|---|---|
| 3,192,734 | A * | 7/1965 | Swanson | 62/137 |
| 3,608,786 | A * | 9/1971 | Shelley et al. | 222/232 |
| 3,789,570 | A * | 2/1974 | Mullins, Jr. | 53/459 |
| 3,913,343 | A * | 10/1975 | Rowland et al. | 62/137 |
| 3,918,266 | A * | 11/1975 | Gindy et al. | 62/137 |
| 4,404,817 | A * | 9/1983 | Cox, III | 62/320 |
| 4,694,661 | A * | 9/1987 | Landers | 62/344 |
| 4,732,301 | A * | 3/1988 | Tobias et al. | 222/203 |
| 4,942,983 | A * | 7/1990 | Bradbury | 222/238 |
| 5,230,448 | A * | 7/1993 | Strohmeyer et al. | 222/643 |
| 5,277,016 | A * | 1/1994 | Williams et al. | 53/459 |
| 5,581,982 | A * | 12/1996 | Schroeder et al. | 53/459 |
| 6,209,339 | B1 * | 4/2001 | Schroeder et al. | 62/303 |
| 6,305,177 | B1 * | 10/2001 | Edwards et al. | 62/66 |
| 7,421,834 | B1 * | 9/2008 | Doolan | 53/570 |

* cited by examiner

*Primary Examiner*—William E Tapolcai
(74) *Attorney, Agent, or Firm*—Charles Peeler

(57) ABSTRACT

The present invention is an automated ice vending machine for delivering ice to consumers. The machine of the present invention includes an insulated enclosure, an ice manufacturing apparatus, a cooling unit, an ice inventory storage bin, an ice agitating device, an incline ice transport device, and a bagger assembly. The present invention also includes a method of vending ice to a consumer.

15 Claims, 9 Drawing Sheets

AUTOMATED ICE VENDING MACHINE AND METHOD OF VENDING ICE

RELATED APPLICATIONS

This application claims priority to provisional patent application No. 60/748,346 entitled "Automated Ice Vending Machine" filed Dec. 7, 2005 in the name of Robert Michael Hobson, et al.

FIELD OF INVENTION

The present invention relates to an automated ice vending and bagging machine that stores an amount of ice and delivers said ice to a consumer. The present invention also comprises a method of vending ice to a consumer.

BACKGROUND OF THE INVENTION

Ice bagging machines and ice vending machines are known in the art in general. For example, U.S. Pat. No. 6,932,124 discloses an automated ice bagging apparatus that transports ice in a substantially horizontal direction out of a holding bin to a second transport device that transports said ice to a scale to allocate a predetermined amount of ice to a bag. Additional examples of ice vending, ice bagging and vending machines are set forth in the background section of U.S. Pat. No. 6,932,124. Many known ice vending and bagging machines contain multiple components for transporting ice from a holding bin to a bag. What is needed in the art is an ice vending and bagging machine that uses gravity to transport ice out of a holding bin to a transport device which transports ice pieces from a holding bin to a bag for delivery to a consumer.

SUMMARY OF THE INVENTION

The present invention relates to an automated ice vending machine including an insulated enclosure; a cooling unit; an ice manufacturing apparatus; an ice inventory holding bin; an ice agitating device; and an incline ice transport device for delivering ice from an ice inventory holding bin to an ice bagger assembly. The ice bagger assembly includes a blower; an airstream channel device; a bag opening assembly; a bag storage rack; a sensor for detecting the presence of a container (such as a bag) beneath an ice depositing chute; a sensor for detecting an appropriate level of ice in a bag; and a bag support and drop platform for supporting a bag during a bag filling process and for delivering a filled bag of ice to a consumer. In the present invention, the ice manufacturing apparatus can be situated on top of the insulated container or beside the insulated container.

BRIEF DESCRIPTION OF THE DRAWINGS

FIG. 1 further depicts an ice inventory holding bin; ice agitating device; incline ice transport device; and a bagger assembly;

DETAILED DESCRIPTION OF THE PREFERRED EMBODIMENTS

In the following detailed description of the preferred embodiments, reference is made to the accompanying drawings which form a part hereof, and within which are shown by way of illustration specific embodiments by which the invention may be practiced. It is to be understood that other embodiments may be utilized and structural changes may be made without departing from the scope of the invention.

Figure 1:
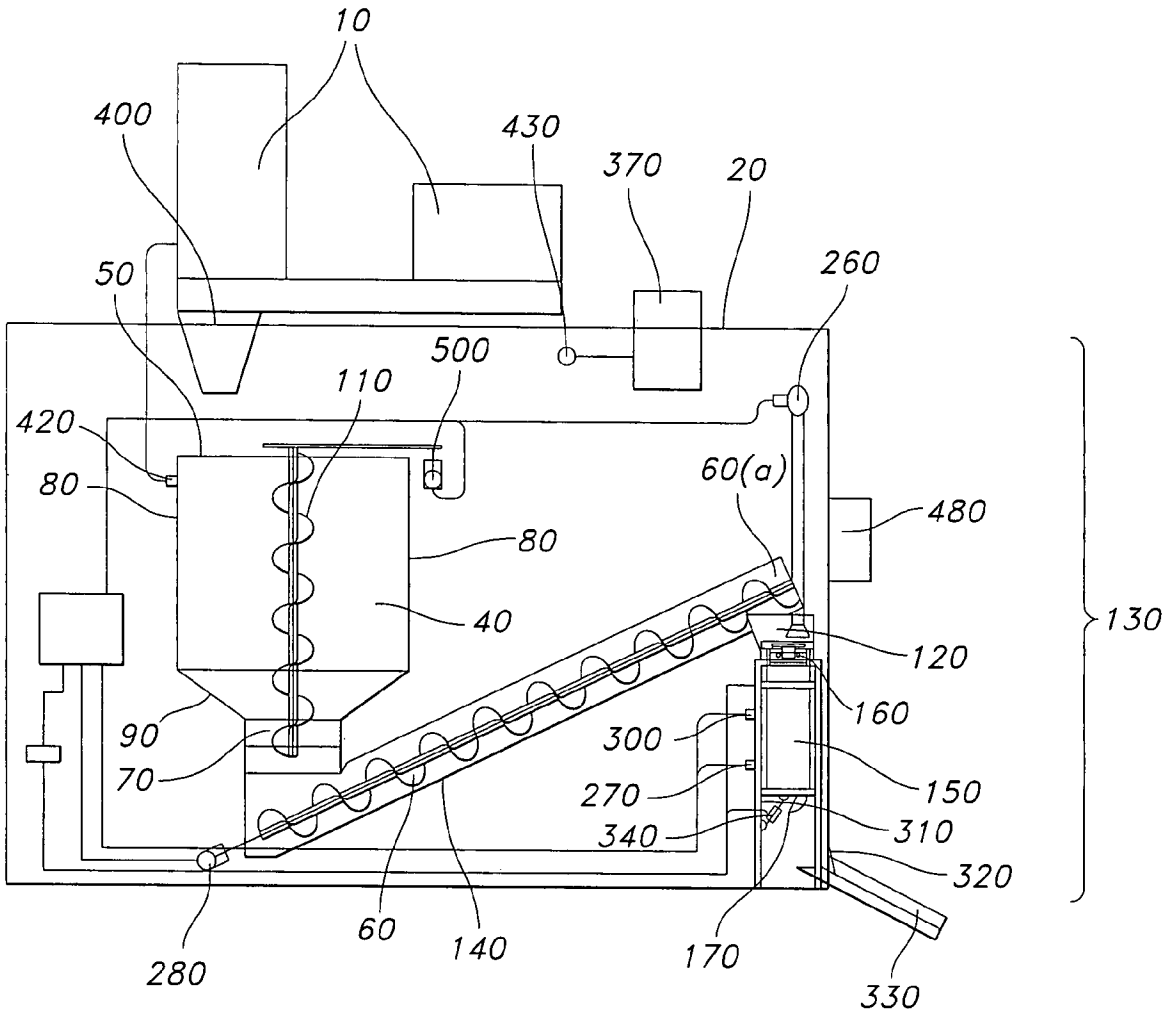
FIG. 1 represents a side view of the interior of the insulated enclosure wherein the ice manufacturing device is located on top of the insulated enclosure.

Turning now to the drawings wherein like numbers refer to like features throughout the drawings, the present invention comprises an automated ice vending apparatus for delivering ice to a consumer. A consumer may be required to pay for said ice with cash or credit or debit cards or tokens. Alternatively, ice may be delivered to a consumer without requiring payment. As set forth in FIG. 1, the present invention comprises an insulated enclosure (20). The insulated enclosure may be made from virtually any insulating material (such as fiberglass, plastic, foam, etc.) sufficient to efficiently maintain the inside environment of the enclosure (20) at or around between 25 and 50 degrees Fahrenheit. In a preferred embodiment, the insulated enclosure (20) is made of fiberglass, such as commercially available fiberglass insulated enclosures available from Polar King, Inc. in Ft. Wayne, Ind. The insulated enclosure (20) is of dimensions sufficient to allow the enclosure to house the other components of the present invention such as without limitation an ice inventory holding bin (40); an ice agitating device (110); an incline ice transport device (60); an ice delivery chute (120); a bagger assembly (130); and an ice support and drop platform (170). In preferred embodiments, the dimensions of the insulated enclosure range as follows: from approximately 13 (L)×8 (W)×10 (H) feet to approximately 6 (L)×4 (W)×7 (H) feet. One of ordinary skill in the art will recognize that it is commercially advantageous to minimize the size of the insulated enclosure without minimizing the efficiency of the present invention.

Figure 2:
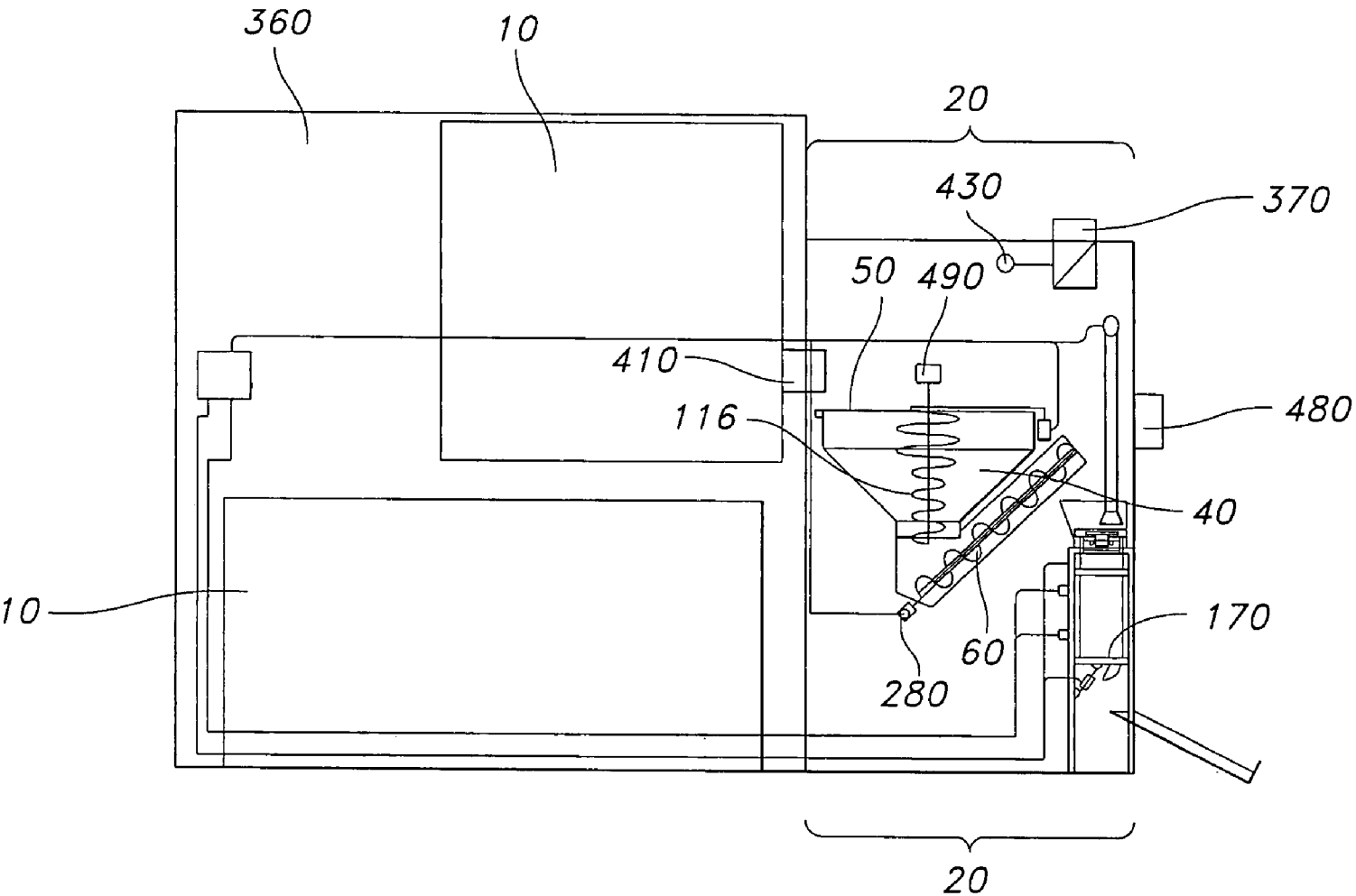
FIG. 2 represents a side view of the interior of the insulated enclosure wherein the ice manufacturing device is located beside the insulated enclosure.
Figure 7:
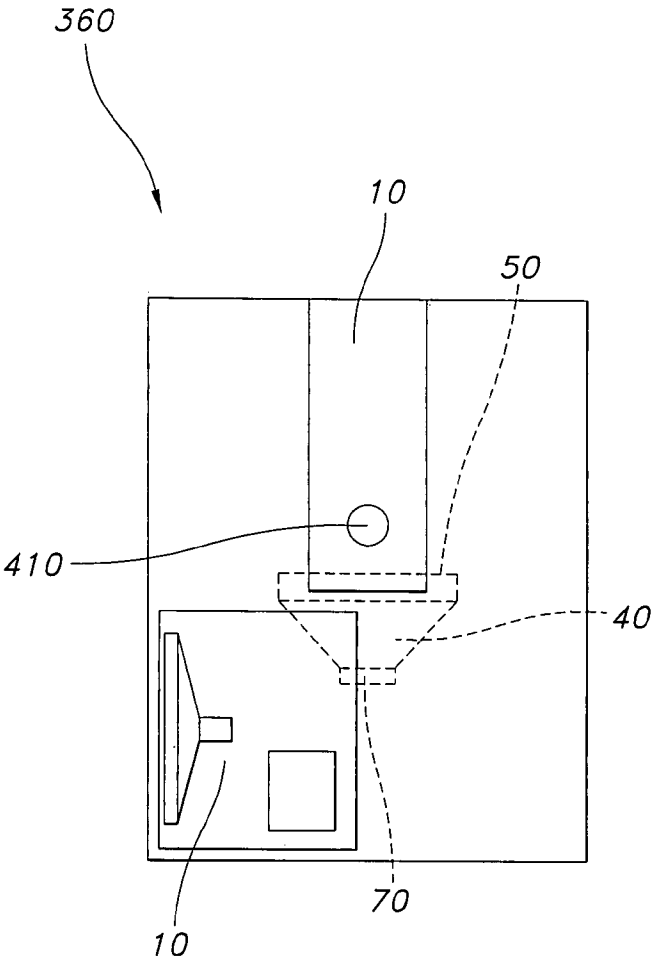
FIG. 7 represents an end view of the equipment storage zone which houses the ice manufacturing apparatus outside of the insulated enclosure. The holding bin is represented in broken lines illustrating its presence within the insulated enclosure.

The present invention also includes an ice manufacturing machine (10). Ice manufacturing machines are readily commercially available from entities such as Holiday Ice, Inc. in Longwood, Fla. In a preferred embodiment, the ice manufacturing machine of the present invention should be capable of producing between approximately 3000 and 20,000 pounds of ice per day. In one embodiment of the present invention, as set forth in FIG. 1, the ice manufacturing machine (10) resides on top of the insulated enclosure (20). In this embodiment, ice pieces travel from the ice manufacturing machine through an opening (400) in the top of the insulated enclosure into an ice inventory holding bin (40). In another embodiment, and as depicted in FIG. 2 and FIG. 7, the ice manufacturing machine (10) resides beside the insulated enclosure (20). In this embodiment, ice pieces travel through an opening (410) in the side of the insulated enclosure and into an ice inventory holding bin (40). The ice manufacturing machine may reside in a separate enclosure such as an equipment storage zone (360). (See FIGS. 2 and 7.) Preferably, the ice manufacturing machine does not reside within the same insulated enclosure as the ice inventory holding bin (40) because storage of the ice manufacturing machine in such a cold environment (between approximately 25 and 50 degrees Fahrenheit) may interfere with the efficient operation of the ice manufacturing machine (10).

In the present invention, ice is delivered from the ice manufacturing machine (10) to an ice inventory holding bin (40) which resides inside the insulated enclosure (20). The ice inventory holding bin (40) may be manufactured from sturdy material sufficient to hold many pounds of ice pieces. In preferred embodiments, the ice inventory holding bin (40) holds between approximately 100 and 1000 pounds of ice, depending on the capacity of the ice manufacturing machine (10) and the desired output of the ice vending apparatus. Examples of such sturdy material include without limitation plastic, foam, fiberglass, stainless steel, and any other sturdy food grade material. The ice inventory holding bin (40) includes an aperture (50) at or near the top of the ice inventory holding bin (40) sufficient in size for ice pieces to be delivered from the ice manufacturing machine (10) into the ice inventory holding bin (40).

The ice inventory holding bin (40) also includes an aperture (70) at the bottom of the ice inventory holding bin (40) sufficient in size for ice to efficiently exit the ice inventory holding bin (40) and come into contact with an incline ice transport device (60) which delivers ice towards a bagger assembly (130). In a preferred embodiment, the aperture (70) is of a sufficient size to allow ice pieces to travel from the ice inventory holding bin (40) to the incline transport device (60) at a rate of approximately 0.5 to 3.0 pounds per second.

The side walls (80) of the ice inventory holding bin (40) may be straight or curved resulting in a substantially rectangular or substantially circular bin. In a preferred embodiment, the bottom surface walls (90) of the ice inventory holding bin (40) are angled such that ice funnels downward towards the bottom of the ice inventory holding bin (40) thereby facilitating the exit of the ice pieces through the aperture (70) in the bottom of the ice inventory holding bin (40). Ice pieces exit the ice inventory holding bin in a substantially vertical manner. Therefore, gravity assists the departure of ice pieces from the ice inventory holding bin (40). In a preferred embodiment, the bottom surface walls (90) of the ice inventory holding bin (40) are angled between 30 and 60 degrees from horizontal, with preference to 45 degrees. After exiting through the aperture (70) in the bottom of the ice inventory holding bin (40), ice pieces come in contact with an incline ice transport device (60). The dimensions of the ice inventory holding bin (40) will vary depending on the amount of ice to be held in the bin. In one embodiment of this invention wherein the ice inventory holding bin holds approximately 500 lbs of ice, the diameter of the opening (50) at the top of the ice inventory holding bin (40) is approximately 40 inches; the diameter of the opening (70) at the bottom of the ice inventory holding bin (40) is approximately 7 inches; and the height of the ice inventory holding bin (40) is approximately 50 inches. One of ordinary skill in the art will realize that the dimensions of the ice inventory bin (40) may vary so long as the bin fits within the insulated enclosure and allows room for without limitation the incline ice transport apparatus and bagging assembly.

Figure 8:
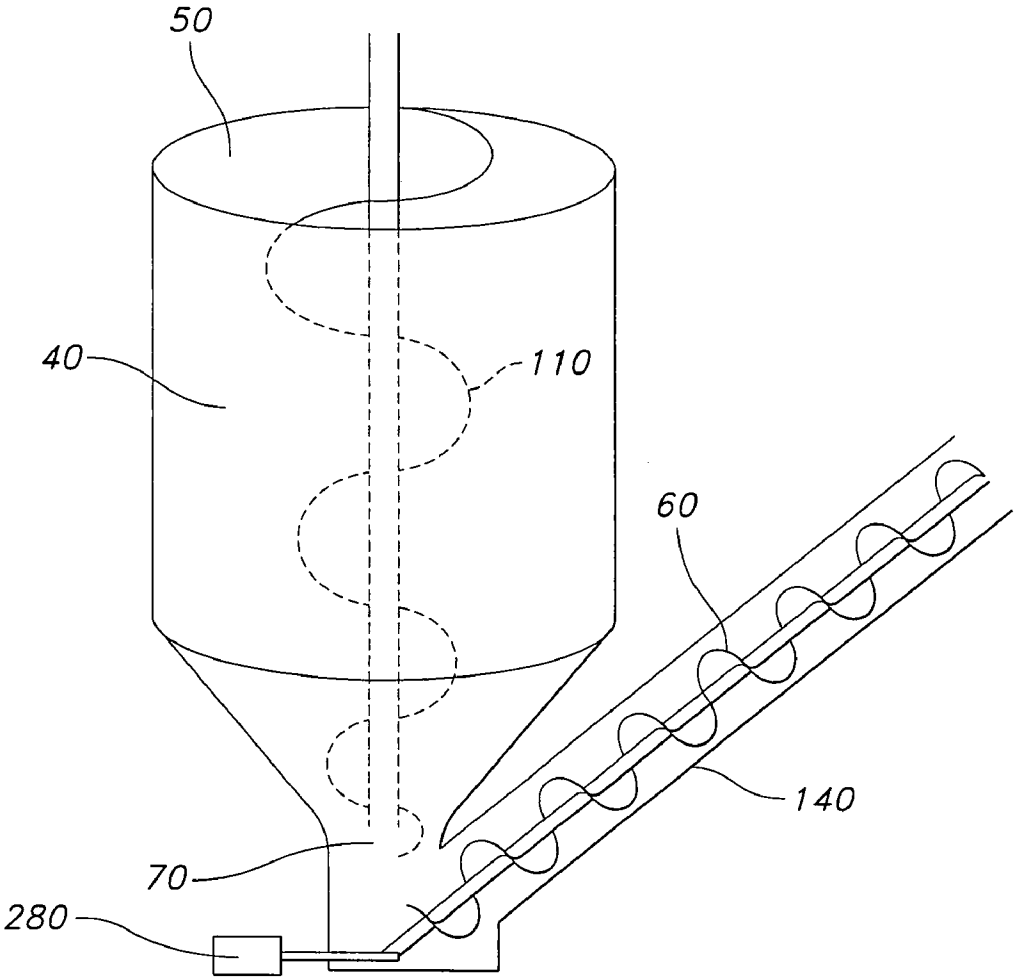
FIG. 8 represents a side view of the ice inventory holding bin reflecting angled walls for funneling ice to the bottom end of an incline ice transport device. Further represented is an ice agitating device for agitating ice in the bin.

In a preferred embodiment, the ice inventory holding bin (40) includes an ice agitating device (110). The ice agitating device (110) may be vertically oriented in approximately the middle of the ice inventory holding bin (40) and traverse from approximately the top of the bin (40) to approximately the bottom of the bin (40). Ice pieces in the ice inventory holding bin (40) may have the tendency to freeze together if left un-agitated for periods of time. The ice agitating device (110) functions to stir or chum the ice in the bin so as to reduce instances when ice pieces become frozen together and/or to break apart ice pieces that have frozen together. The ice agitating device (110) also may assist ice pieces through the aperture (70) in the bottom surface of the ice inventory holding bin (40). The ice agitating device (110) may be programmed to stir or churn ice pieces in the ice inventory holding bin at predetermined time intervals. In a preferred embodiment, the ice agitating device (110) is driven by a small motor such as a 1 hp motor. The motor connection may be belt (500) or direct drive (490). In a preferred embodiment, the ice pieces in the ice inventory holding bin (40) are stirred for approximately 5-30 seconds 2-6 times per hour. In a preferred embodiment, the ice agitating device is an auger. In a further preferred embodiment, the auger is approximately 6-12 inches in pitch and diameter. The auger blades may be tapered with larger blades at the top of ice inventory holding bin and smaller blades at the bottom of the ice inventory holding bin near the bottom aperture (70). (See FIG. 2 and FIG. 8, 110). The ice agitating auger may be stimulated by a programmable logic control to rotate in a clockwise or counterclockwise direction. Depending on the configuration of the auger blades, rotating the auger in one direction causes ice pieces to be stirred in an upward direction which facilitates breaking apart ice pieces that have frozen together by "churning" the ice in the ice inventory holding bin (40).

The ice inventory holding bin (40) may be further equipped with a sensor (420) such as a reflective or capacitance sensor for detecting the level of ice in the ice inventory holding bin. When the ice reaches a predetermined level in the ice inventory holding bin (40), the sensor (420) detects the level and transmits a signal to the ice manufacturing device (10) not to manufacture more ice. This prevents over-filling the ice inventory holding bin (40). Likewise, when ice is not detected at the level of the sensor (420), the ice manufacturing device may be activated to manufacture ice pieces to be delivered to the ice inventory holding bin.

The insulated enclosure of the present invention is further equipped with a cooling unit (370) such as a commercially available cooling unit manufactured by Russell, Heat Craft, Larkin and the like. The cooling unit (370) should be sufficient to bring and maintain the interior of the insulated enclosure at a temperature at or around 32° Fahrenheit. The preferred range of temperature is between 25 and 40 degrees Fahrenheit, although the operational temperature of the invention may exceed 40 degrees. The cooling unit (370) is equipped with a thermostat (430) for controlling the temperature inside the insulated enclosure. The cooling unit (370) may be situated on top or beside the insulated enclosure.

The present invention further comprises an incline ice delivery apparatus (60) operably positioned to receive ice from a substantially vertical direction from the ice inventory holding bin (40) through an aperture (70) and deliver such ice to a bagger assembly (130). Upon receipt of ice pieces from the ice inventory holding bin (40), the incline ice transport apparatus (60) transports ice pieces at approximately a 45-degree angle from beneath the ice inventory holding bin (40) to a bagger assembly (130). The ice may pass through an ice bag filling chute (120) prior to entering a bag. The incline ice transport apparatus (60) may be an auger, a conveyer or any other means sufficient to transport ice at approximately a 45-degree angle towards an ice bagging assembly (130). In a preferred embodiment, the incline ice transport device (60) is an auger with pitch and diameter of between approximately 6 and 12 inches. In instances when the incline transport device (60) is an auger, ice pieces are pushed by the auger through a trough or pipe (140) which is in contact or near contact with the auger. The incline ice transport apparatus (60) may be driven by a motor (280) such as a one horsepower gear motor. In a preferred embodiment, the incline ice transport device (60) transports ice from beneath the ice inventory holding bin to an ice delivery chute (120) at approximately a 45-degree angle. In a preferred embodiment, the incline angle of the incline ice transport apparatus (60) is in the range of approximately 45 degrees from horizontal. The incline ice transport device (60) may be activated pursuant to programmable logic when a bag of ice needs to be filled. Upon activation, the incline ice transport device (60) delivers ice from beneath the ice inventory holding bin (40) through the aperture (70) to a bagger assembly (130) and into a bag (150). An ice delivery chute (120) may channel ice pieces from the incline transport device (60) to an open container such as a bag.

Figure 3:
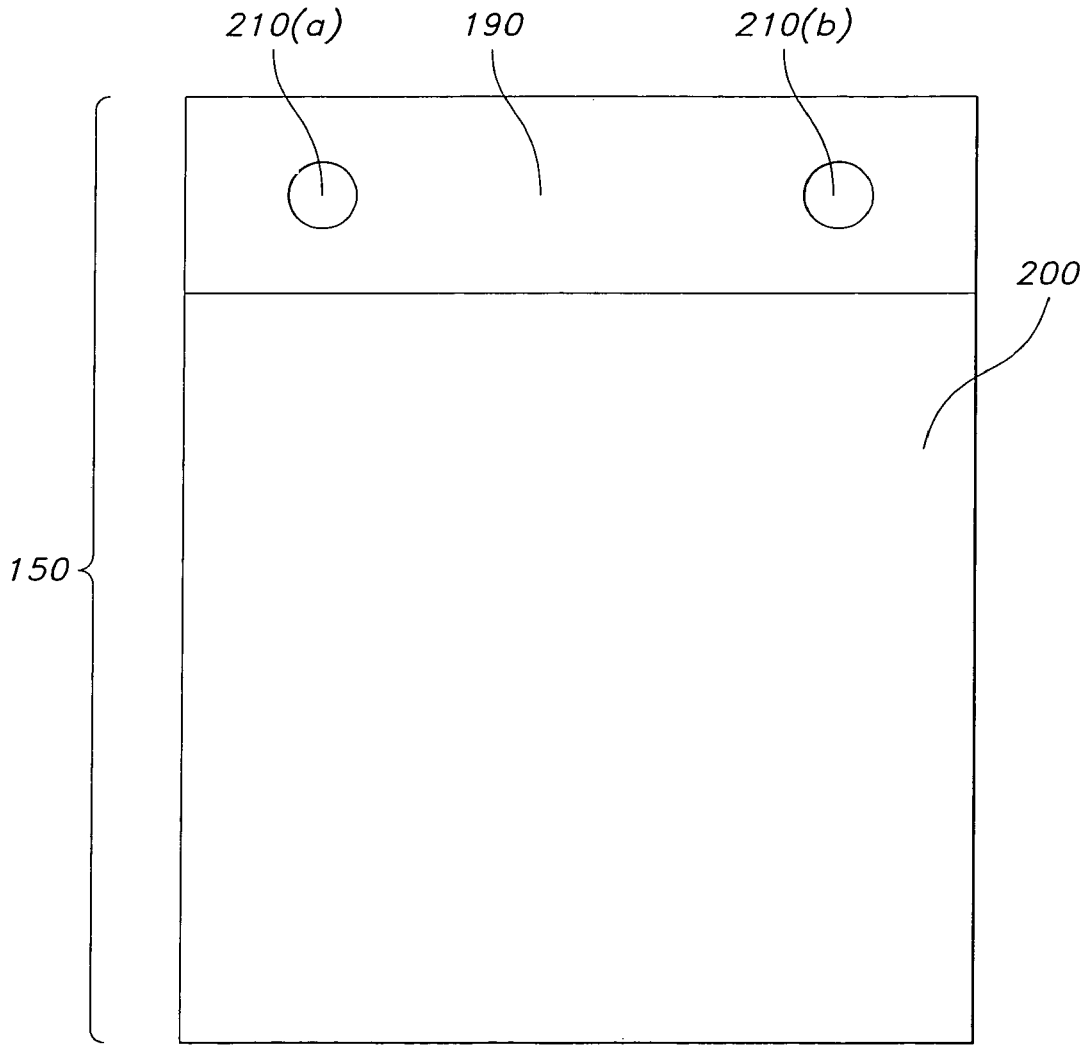
FIG. 3 represents a typical bag which may be used in the present invention to deliver ice to a consumer; said bag comprising of two sheet members wherein one sheet member extends above the bag opening and include two holes through which two corresponding prongs of a bag holder apparatus can extend so as to hold the bag on a bag rack.
Figure 4:
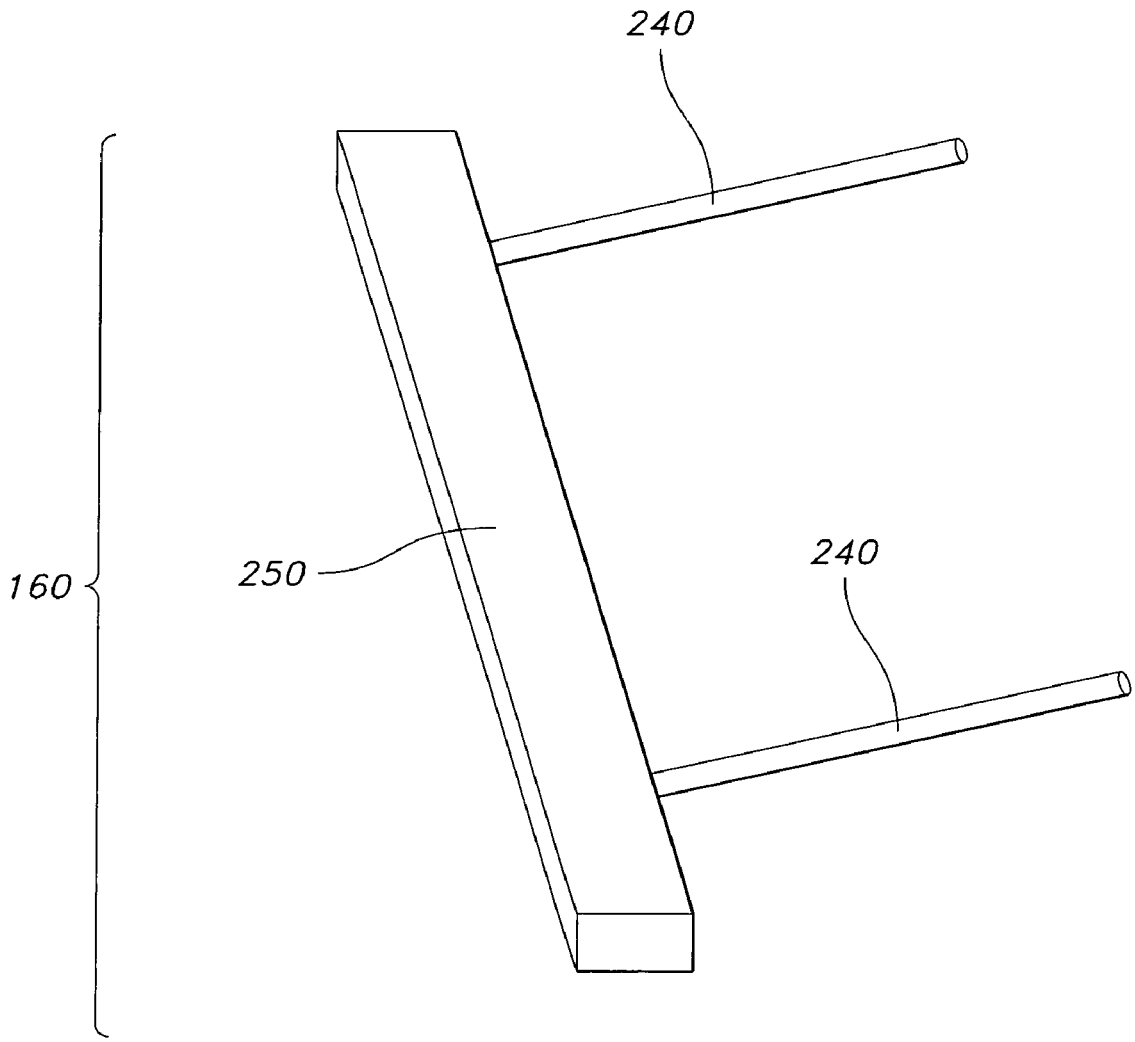
FIG. 4 represents a bag holding device wherein the bag holding device is comprised of two parallel prongs extending from a plate wherein the prongs extend through two corresponding holes in one sheet of a bag so as to hold the bag on a bag rack.
Figure 5:
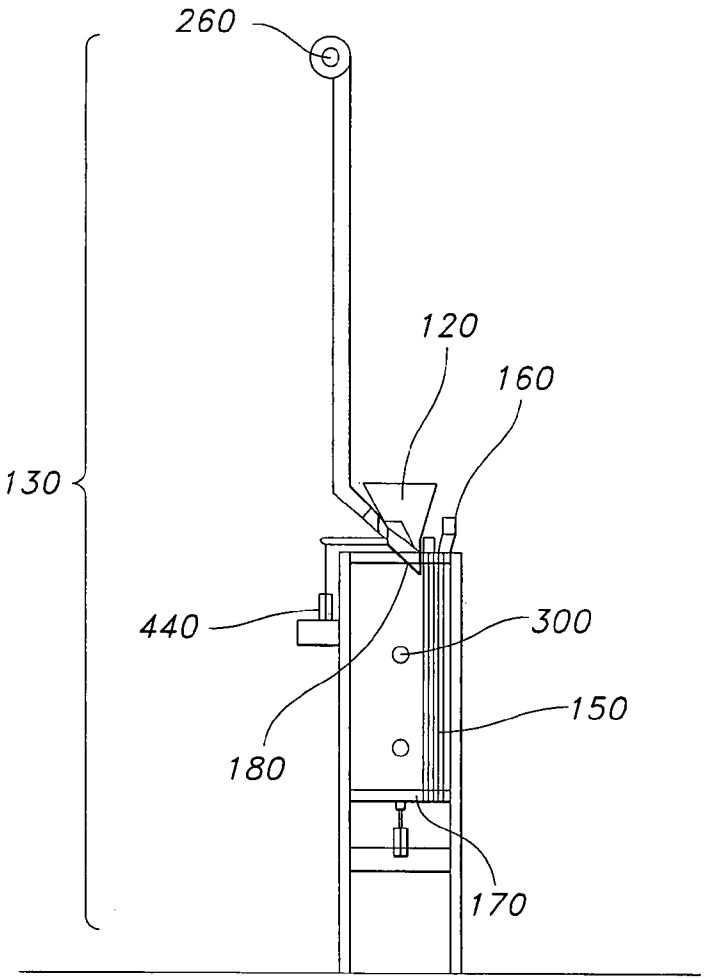
FIG. 5 represents a front view of the bagger assembly of the present invention.
Figure 6:
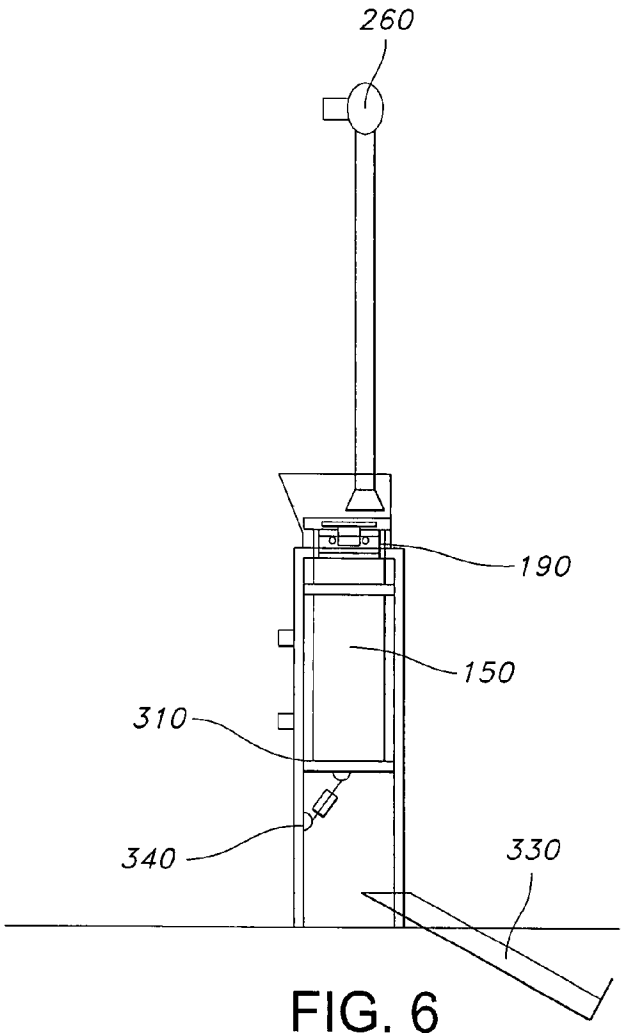
FIG. 6 represents a side view of the bagger assembly of the present invention.

The present invention further comprises a bagger assembly (FIG. 5, 130). The bagger assembly (130) is comprised of a bag storage device (160); a bag opener device (180); a bag opener blower (260); and a bag support platform (170). The bag storage device (160) is an apparatus sufficient for holding or storing bags. In a preferred embodiment, the bag storage device (FIG. 4, 160) is a two pronged rack wherein each prong (240) extends through a corresponding hole (210) in the top of a plastic bag (150). In this embodiment, the plastic bag (FIG. 3) is comprised of two plastic sheets (190 and 200) affixed together thereby forming a bag sufficient to hold between 0 and 40 lbs of ice. Each sheet is of approximately the same width. One sheet (190) is of a larger height than the other sheet (200). The larger sheet (190) includes two holes (210*a* and 210*b*) through which the prongs (240) of a bag storage device (160) may travel so as to hold the bag. The bag storage device (160) may be angled in a downward direction to facilitate the delivery of a bag to an area underneath the ice dispensing end (60*a*) of the incline ice delivery device (60). In a preferred embodiment the prongs (FIG. 4, 240), extend from a plate (250) which exerts pressure against the top portion (190) of the higher sheet (190) of the bag.

The bagger assembly is further comprised of a bag opener device (FIG. 5, 180). The bag opener device opens a bag prior to ice being deposited in the bag. The bag opener device (180) may be approximately U-shaped to channel a stream of air from a blower (260) to the inside surface near the top of the high side (190) of the bag. Programmable logic control energizes a blower (260) to direct an air stream into a bag to at least partially fill the next available bag with air thereby causing the bag to open at the top. When the bag opens, the bag opener (180) lowers into the bag thereby holding the top of the bag open so that ice may be deposited into the bag. The lowering of the bag opener may be accomplished via an actuator (440).

Figure 9:
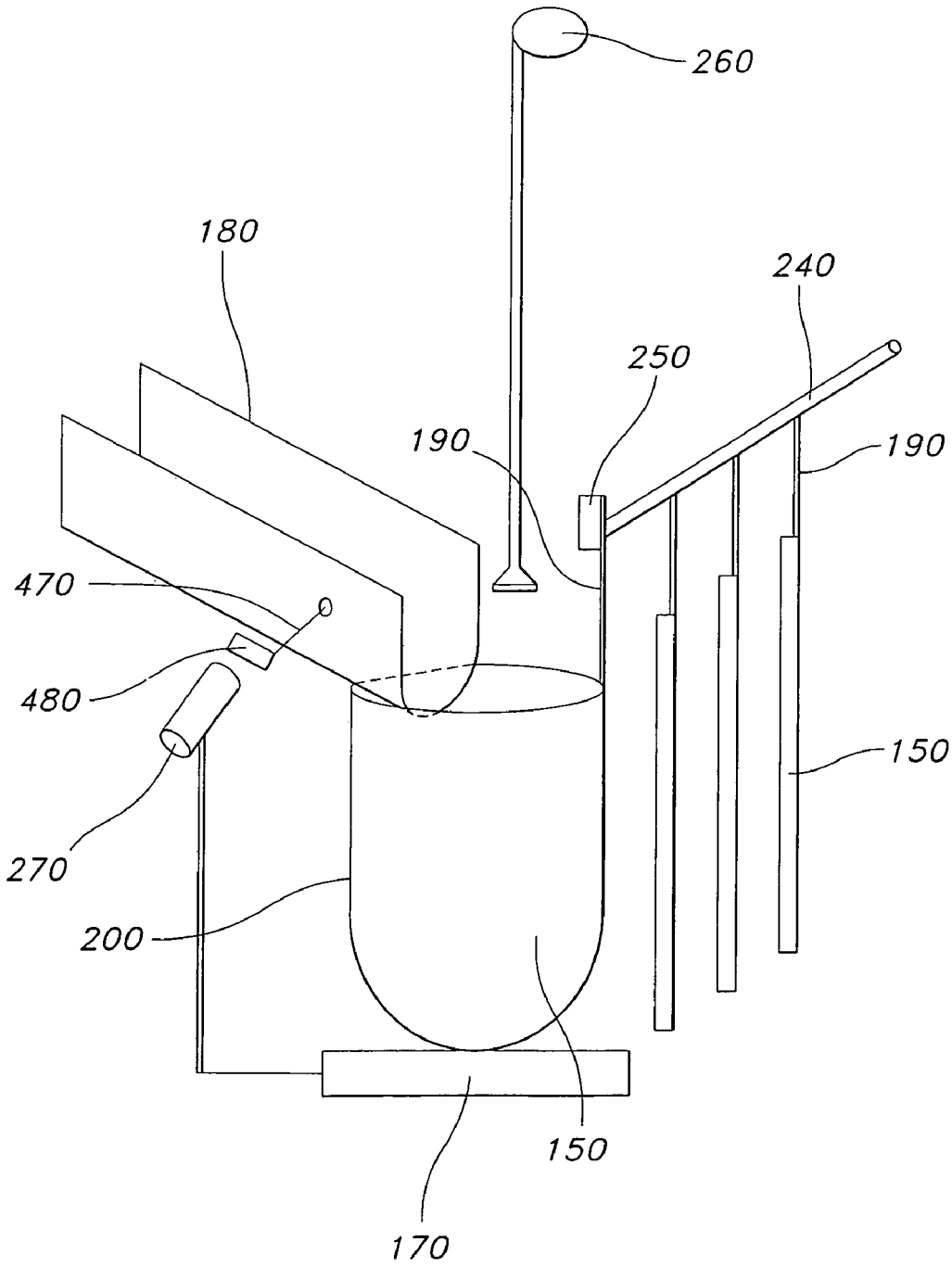
FIG. 9 represents a side view of the bagger assembly reflecting bag rack, an open bag, a bag detection sensor, swinging metal rod with flag, bag opener device and blower.

When a bag is open and in place beneath the ice depositing end (60*a*) of the incline ice transport device (60), the bag is detected by a bag detection sensor (270). One of ordinary skill in the art will realize that the bag detection sensor may be any poly-detector such as a Cutler Hammer clear object detector or equivalent. In an alternate embodiment, the bag detection sensor may read the lowered nature of the bag opener device (180) by sensing the metal of the bag opener device (180). As set forth in FIG. 9, when the bag is open, the shorter side of the bag (200) is moved away from the longer side (190) by the air blast. The shorter side (200) may then push a free swinging rod (470) which when the short side (200) of the bag is open enough to receive ice pieces, the rod (470) covers the bag open sensor (270) with a flag-shaped end (480). This sensor (270) like the other sensors, can be magnetic, capacitance, or light sensors. When the bag open sensor (270) senses that the bag is open, the bag opener device (180) inserts into the top of the bag, holding the short side (200) of the bag away from the long side (190). The blower (260) is then de-energized and ice is delivered into the open bag. In any event, the bag detection sensor should detect the presence OR absence of an open bag so as to control when the ice is channeled towards the bag fill area. The bag detection sensor may be a capacitance or reflective sensor. When the bag detection sensor (270) does not detect a bag, the blower and bag opener may activate to open a bag and hold the bag open beneath the ice depositing end (60*a*) of the incline ice transport device (60).

When the bag detection sensor senses the presence of a bag beneath the ice depositing end (60*a*) of the incline ice transport device (60), a motor (280) may be activated to power the incline ice transport device (60) to deliver ice from beneath the ice inventory holding bin (40) to an area above an open bag and then into the bag. The ice pieces may pass from the incline ice transport device (60) through an ice chute (290) prior to being deposited into a bag. The ice chute (290) is of dimensions sufficient to channel ice from the incline ice transport device (60) to the bag and minimize spillage of ice pieces during the transfer from the incline ice transport device to the bag.

When a bag is open, the bag opener (180) is lowered into the bag in order to hold the bag open for filling. During filling, ice pieces are funneled or channeled into the bag by the bag opener (180). An ice detection sensor (300) sends a signal to the motor (280) to cease delivery of ice to a bag via the incline ice transport device (60) when ice pieces reach a predetermined height in the bag. Ice pieces entering the bag are shielded from the ice detection sensor (300). In one embodiment, ice pieces entering the bag are shielded from the ice detection sensor by the bag opener (180). In this embodiment, the bag opener (180) funnels ice down the high side (190) of the bag while the ice detection sensor (300) detects the ice level in an area of the bag away from the pathway of ice falling into the bag.

A bag support platform (170) supports a bag that has been filled with ice. When a consumer indicates that the consumer desires a bag of ice, the bag support platform (170) ceases supporting the bag of ice so that the bag of ice may be delivered outside the insulated enclosure to a waiting consumer. In a preferred embodiment, the bag support platform (170) is a plate situated beneath a bag that is being filled or that has been filled with ice. In this embodiment, the bag support platform (170) may be hinged on one side (310). When ice is to be delivered to a consumer, the bag support platform drops, the holes of the bag (210*a* and 210*b*) tear from the prongs (240) due to the unsupported weight of the full bag of ice, and the bag is delivered outside of the insulated enclosure (20) through a swinging seal door (320) to a consumer via a bag delivery chute (330). After delivery, the bag support platform is returned to the support position via an actuator (340). After the bag exits the swinging seal door (320), the bag drop platform (170) returns to near horizontal so as to support the next bag of ice. The movement of the bag support platform (170) can be controlled with an air or electric actuator (340).

In one embodiment of the invention, a bag ejection assistance mechanism exerts pressure of a bag of ice in a direction of the swinging seal door (320) so as to facilitate the exit of the bag of ice. The bag ejector assistance mechanism may be operatively attached to the bag support platform actuator so that as the bag support platform drops (or lowers) the bag ejector assistance mechanism exerts lateral force against the bag of ice in a direction toward the swinging seal doors (320). This force helps channel a full bag of ice down the bag delivery chute (330) and out of the device to a consumer.

The present invention may further comprise a coin/bill validator (480) sufficient for validating currency inserted by a consumer. The present invention may also include a credit or debit card reader sufficient to extract payment from a consumer for a bag of ice.

What is claimed is:

1. An automated ice vending machine comprising:

an ice manufacturing apparatus;

a chilled insulated enclosure equipped with a cooling unit housing an ice inventory holding bin having a top opening for receiving ice pieces from the ice manufacturing apparatus, a smaller opening at the bottom for depositing ice pieces in a substantially downward direction into an incline ice delivery device, and an auger for stirring ice pieces in the ice inventory holding bin; and an incline ice delivery device for receiving ice pieces through an opening in the bottom of the ice inventory holding bin and for delivering ice pieces in a generally upward direction from beneath the ice inventory holding bin to a container such as a bag.

2. The invention of claim 1, wherein the ice inventory holding bin further comprises:

an ice level detection sensor for detecting ice at a predetermined level near the top of the ice inventory holding bin.

3. The invention of claim 2, wherein the incline ice delivery device delivers ice pieces from beneath the ice inventory holding bin in a generally upward direction of approximately 45 degrees to a bag.

4. The invention of claim 3 further comprising a bagger assembly.

5. The invention of claim 4, wherein the ice manufacturing apparatus is on top of the insulated enclosure.

6. The invention of claim 4, wherein the ice manufacturing apparatus is beside the insulated enclosure.

7. The invention of claim 1, wherein the auger blades are tapered from the top of the ice inventory holding bin to the bottom of the ice inventory holding bin.

8. The invention of claim 7, wherein the incline ice delivery device comprises a trough holding an auger.

9. A method for providing a bag of ice to a consumer comprising the steps of:

manufacturing ice pieces;

delivering manufactured ice pieces through an opening in the top of an ice inventory holding bin located within a chilled insulated enclosure, wherein the ice inventory holding bin is substantially cone shaped with an opening in the top for receiving ice pieces from an ice manufacturing apparatus, a smaller opening at the bottom for depositing ice pieces in a substantially downward direction into an incline ice delivery device, and an auger for stirring ice pieces in the ice inventory holding bin;

transporting ice in a substantially downward direction through an opening in the bottom of the ice inventory holding bin to an incline ice transport device;

delivering ice via the incline ice transport device in a generally upward direction from beneath the ice inventory holding bin to a bag, wherein such bag has been automatically opened by bagger assembly.

10. The method of claim 9, wherein the ice inventory holding bin further comprises:

an ice level detection sensor for detecting ice at a predetermined level near the top of the ice inventory holding bin.

11. The method of claim 9, wherein a bag for receiving ice pieces is opened by a bagger assembly, said bagger assembly comprising a blower, a bag opener device, a bag holding apparatus, a bag support platform, a bag detection sensor, and an ice level detection sensor.

12. The invention of claim 11, wherein the auger comprises blades that are tapered from the top of the ice inventory holding bin to the bottom of the ice inventory holding bin.

13. An automated ice vending machine comprising:

an ice manufacturing apparatus;

a chilled insulated enclosure equipped with a cooling unit housing a substantially cone-shaped ice inventory holding bin with an opening at the top for receiving ice pieces from the ice manufacturing apparatus and a smaller opening at the bottom for depositing ice pieces in a substantially downward direction into an incline ice delivery device; and an incline ice delivery device for receiving ice pieces through an opening in the bottom of the ice inventory holding bin and for delivering ice pieces in a generally upward direction from beneath the ice inventory holding bin to a container such as a bag;

an ice agitating device in the form of an auger for stirring ice pieces in the ice inventory holding bin, wherein blades of the auger are tapered from the top of the ice inventory holding bin to the bottom of the ice inventory holding bin; and an ice level detection sensor for detecting ice at a predetermined level near the top of the ice inventory holding bin; and a bagger assembly.

14. The automated ice vending machine of claim 13, wherein the incline ice delivery system delivers ice pieces from beneath the ice inventory holding bin in a generally upward direction of approximately 45 degrees to a bag.

15. The automated ice vending machine of claim 13, wherein the bagger assembly comprises a blower, a bag opener device, a bag holding apparatus, a bag support platform, a bag detection sensor, and an ice level detection sensor.

* * * * *